US005831230A

United States Patent [19]

Cole

[11] Patent Number: 5,831,230

[45] Date of Patent: Nov. 3, 1998

[54] APPLIANCE TIMER HAVING A CAM WHICH IS OPERATED AT MULTIPLE SPEEDS

[75] Inventor: Ronald E. Cole, Greenwood, Ind.

[73] Assignee: Emerson Electric Co., St. Louis, Mo.

[21] Appl. No.: 771,561

[22] Filed: Dec. 20, 1996

[51] Int. Cl.[6] ..... H01H 43/00

[52] U.S. Cl. ..... 200/38 R; 200/35 R

[58] Field of Search ..... 200/33 R–33 B; 307/141

[56] References Cited

U.S. PATENT DOCUMENTS

| | | | |
|---|---|---|---|
| 3,681,729 | 8/1972 | Elders | 337/3 |
| 3,828,199 | 8/1974 | Sakai et al. | 307/141 |
| 3,886,802 | 6/1975 | Mason | 74/3.5 |
| 4,103,119 | 7/1978 | Homan et al. | 200/35 R |
| 4,366,352 | 12/1982 | Obermann | 200/35 R |
| 4,418,253 | 11/1983 | Okada | 200/35 R |
| 4,523,062 | 6/1985 | Mahon | 200/35 R |
| 4,755,635 | 7/1988 | Willingman | 200/35 R |
| 5,030,801 | 7/1991 | Amonett | 200/38 R |
| 5,290,978 | 3/1994 | Georgacakis et al. | 200/38 R |
| 5,400,302 | 3/1995 | Yamamoto et al. | 368/107 |
| 5,510,585 | 4/1996 | Duve et al. | 200/35 R |
| 5,637,843 | 6/1997 | Joyce et al. | 200/38 R |

*Primary Examiner*—Michael A. Friedhofer
*Attorney, Agent, or Firm*—Mark D. Becker

[57] ABSTRACT

An appliance timer includes a motor, a first gear assembly which is mechanically coupled to the motor, and a second gear assembly which is also mechanically coupled to the motor. The appliance timer further includes a cam which is driven by (1) the first gear assembly during a first period of time, and (2) the second gear assembly during a second period of time. The cam is decoupled from the first and second gear assemblies during a third period of time. The cam is rotated at a first speed during the first period of time, at a second speed during the second period of time, and is stopped during the third period of time. A method of operating an appliance timer is also disclosed.

19 Claims, 6 Drawing Sheets

| | | | |
|---|---|---|---|
| RING GEAR 58, 60 | $N_S/N_R$ X RPM | ZERO BRAKE | FREE SPIN |
| PLANETARY GEARS 50, 52 | $N_S/N_P$ X RPM | * | FREE SPIN |
| OUTPUT GEAR 30, 46 | ZERO | $\frac{N_S}{N_R+N_S}$ X | FREE SPIN |
| SUN GEAR 28a, 44a | X RPM | X RPM | ZERO (OFF) |

$* \left(\frac{N_R}{N_P}\right)\left(\frac{N_S}{N_R} + N_S\right) \times \text{RPM}$

APPLIANCE TIMER HAVING A CAM WHICH IS OPERATED AT MULTIPLE SPEEDS

BACKGROUND OF THE INVENTION

The present invention relates generally to timing devices, and more specifically to an appliance timer having a cam which is operated at multiple speeds.

Appliance timers are commonly used in many household appliances, such as dishwashers, clothes washers, and clothes dryers. The appliance timer controls operations of the appliance by actuating and deactuating switches which start and stop various work operations within the appliance such as a rinse operation in the case of a dishwasher. The switches within the appliance timer are actuated and deactuated by interaction of a cam surface defined in a cam of the appliance timer and a cam follower which is associated with a particular switch.

One common appliance timer is an interval drive timer. This type of appliance timer typically includes a number of vertically mounted cylindrical cams driven by a ratchet and drive pawl assembly. Each of the cams includes a cam profile defined in an outer surface thereof which selectively actuates one or more switches thereby controlling various work operations of the appliance. In operation, the drive pawl indexes the ratchet at predetermined intervals. Accordingly, the ratchet, and thus the cams attached thereto, are in motion for a first period of time. Thereafter, the ratchet is at rest for a second period of time until the next movement thereof by the drive pawl. For example, a one-minute interval timer may cause the ratchet to be in motion for five seconds and then at rest for 55 seconds.

It is desirable to control an entire cycle of the appliance with one 360° rotation of the cam of the appliance timer. This feature enables the appliance timer to possess a reduced number of parts since only one cam would be necessary in the timer. In addition, this feature enables manual setting of the appliance timer to be simplified. This is true since any operational segment of the appliance cycle may be accessed by manually rotating a setting knob, which is operatively coupled to the cam, a rotational distance of less than 360°.

However, by controlling the entire cycle of the appliance with one 360° rotation of the cam, the amount of cam surface which is available for actuating and deactuating switches within the appliance timer is limited. This becomes a problem since it is desirable to quickly rotate the cam so as to increase the accuracy of the timer. More specifically, the timer's ability to control timing accuracy of the duration of a work operation between the point in time at which the work operation begins and the point in time at which the work operation ends is directly proportional to rotational speed of the cam. This is true since dimensional errors (e.g. manufacturing errors) and design tolerances associated with the components of the timer (e.g. the cam profiles and the cam followers) remain constant regardless of rotational speed of the cam. For example, if the location of a drop along the cam profile associated with actuation of a particular work operation is placed 2° further down the cam profile by a manufacturing error, the cam follower will be required to travel the additional 2° prior to dropping, therefore delaying the actuation of the work operation. If the cam is rotating at a speed of 0.5° per second, actuation of the work operation will be delayed by four seconds. However, if the cam is rotating at a speed of 4° per second, actuation of the work operation will be delayed by only one-half second thereby improving the accuracy of the timer.

Thus, in the operation of an appliance timer, it should be appreciated that there exists a tension between the desire to quickly rotate a cam of an appliance timer so as to improve the accuracy of the timer, and the desire to slowly rotate the cam of the appliance timer so that the entire cycle of the appliance is controlled by one 360° rotation of the cam.

What is needed therefore is an appliance timer which rotates a cam at a high speed when actuating or deactuating switches within the appliance timer so as to more accurately control critical work operations, yet rotates the cam at a low speed when the appliance timer is actuating or deactuating switches of work operations which are not critical so that space on the surface of the cam is conserved.

SUMMARY OF THE INVENTION

In accordance with one embodiment of the present invention, there is provided an appliance timer. The appliance timer includes a group of output terminals and a cam. Defined in the cam are (1) a first set of cam profiles which controls when output signals are to be generated on the group of output terminals, and (2) a second set of cam profiles which controls speed of the cam.

In accordance with a second embodiment of the present invention, there is provided an appliance timer. The appliance timer includes a motor, a first gear assembly which is mechanically coupled to the motor, and a second gear assembly which is also mechanically coupled to the motor. The appliance timer further includes a cam which is driven by (1) the first gear assembly during a first period of time, and (2) the second gear assembly during a second period of time.

In accordance with a third embodiment of the present invention, there is provided a method of operating an appliance timer. The method includes the steps of: (1) providing a cam having defined therein a first set of cam profiles, and a second set of cam profiles, (2) controlling generation of output signals on a group of output terminals of the appliance timer with the first set of cam profiles, and (3) controlling speed of the cam with the second set of cam profiles.

It is therefore an object of the present invention to provide a new and useful appliance timer.

It is another object of the present invention to provide an improved appliance timer.

It is a further object of the present invention to provide a new and useful method of operating an appliance timer.

It is moreover an object of the present invention to provide an improved method of operating an appliance timer.

It is yet another object of the present invention to provide an appliance timer which rotates a cam at a high speed when actuating or deactuating switches associated with critical appliance work operations, and rotates the cam at a low speed when (1) actuating or deactuating switches associated with non-critical work operations or (2) conserving cam space without actuating or deactuating switches.

It is further another object of the present invention to provide an appliance timer which achieves high timing accuracy of the various work operations within the appliance timer, yet controls the entire cycle of the appliance with one 360° rotation of a single cam.

The above and other objects, features, and advantages of the present invention will become apparent from the follower description and the attached drawings.

DETAILED DESCRIPTION OF THE INVENTION

Figure 1:
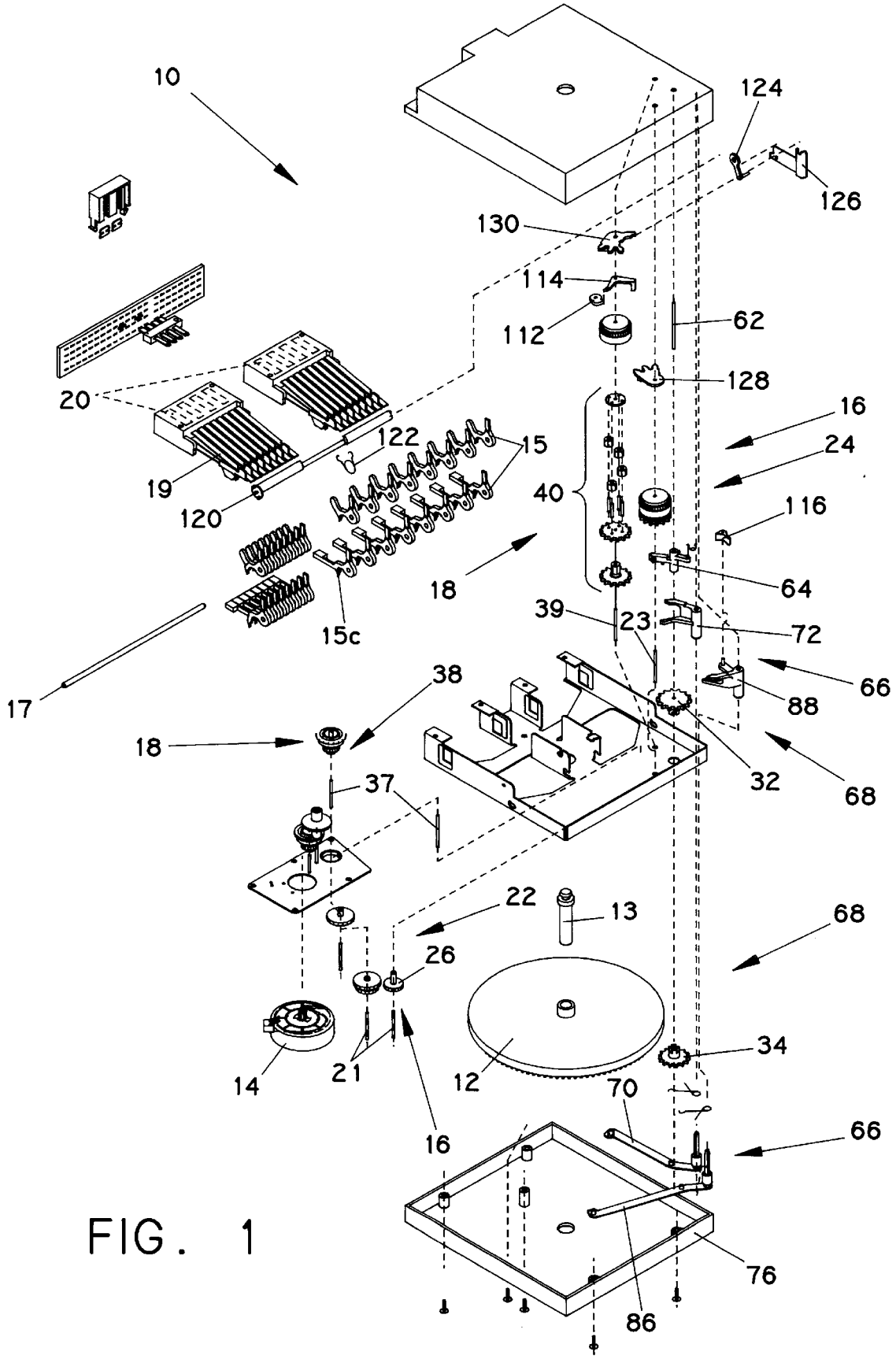
FIG. 1 is an exploded perspective view of an appliance timer which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIGS. 1–4, there is shown an appliance timer 10 which controls a number of work operations within an appliance such as a rinse operation of a dishwasher. The appliance timer 10 includes a cam 12, a motor 14, a high-speed gear assembly 16, a low-speed gear assembly 18, and a group of output terminals 20.

The cam 12 is a flat, horizontally disposed cam of a type commonly referred to in the art as a "pancake" cam. Moreover, the cam 12 is secured to a shaft 13. One manner of securing the cam 12 to the shaft 13 is with a clutch mechanism (not shown).

The appliance timer 10 further includes a number of rocker arms 15 rotatably secured to a rocker arm shaft 17. Each of the rocker arms 15 include a follower member 15*c* which cooperates in a known manner with a number of cam profiles 25 (see FIG. 3) defined in a top side of the cam 12. As each of the rocker arms 15 is selectively moved by a respective cam profile, one of a number of switches 19 is actuated thereby generating an output signal on a respective output terminal 20 so as to electrically couple a device such as an electrically-actuated water valve (not shown) included in the appliance to a power source thereby controlling a particular work operation within the appliance.

The high-speed gear assembly 16 includes a high-speed gear train 22 and a high-speed planetary gear set 24. The high-speed gear train 22 is rotatably disposed on a pair of posts 21, whereas the high-speed planetary gear set is rotatably disposed on a post 23. An output gear 26 of the high-speed gear train 22 meshingly engages an input gear 28 (see FIG. 2) of the high-speed planetary gear set 24. An output gear 30 (see FIG. 2) of the high-speed planetary gear set 24 meshingly engages a transfer gear 32. The transfer gear 32 is non-rotatably coupled to a cam drive gear 34 which meshingly engages a plurality of gear teeth 36 disposed on the cam 12 (see FIG. 3).

Similarly, the low-speed gear assembly 18 includes a low-speed gear train 38 and a low-speed planetary gear set 40. The low-speed gear train 38 is rotatably disposed on posts 37, whereas the low-speed planetary set 40 is rotatably disposed on a post 39. An output gear 42 of the low-speed gear train 38 meshingly engages an input gear 44 (see FIG. 2) of the low-speed planetary gear set 40. An output gear 46 (see FIG. 2) of the low-speed planetary gear set 40 meshingly engages the transfer gear 32.

Figures 5A, 5B, 5C:
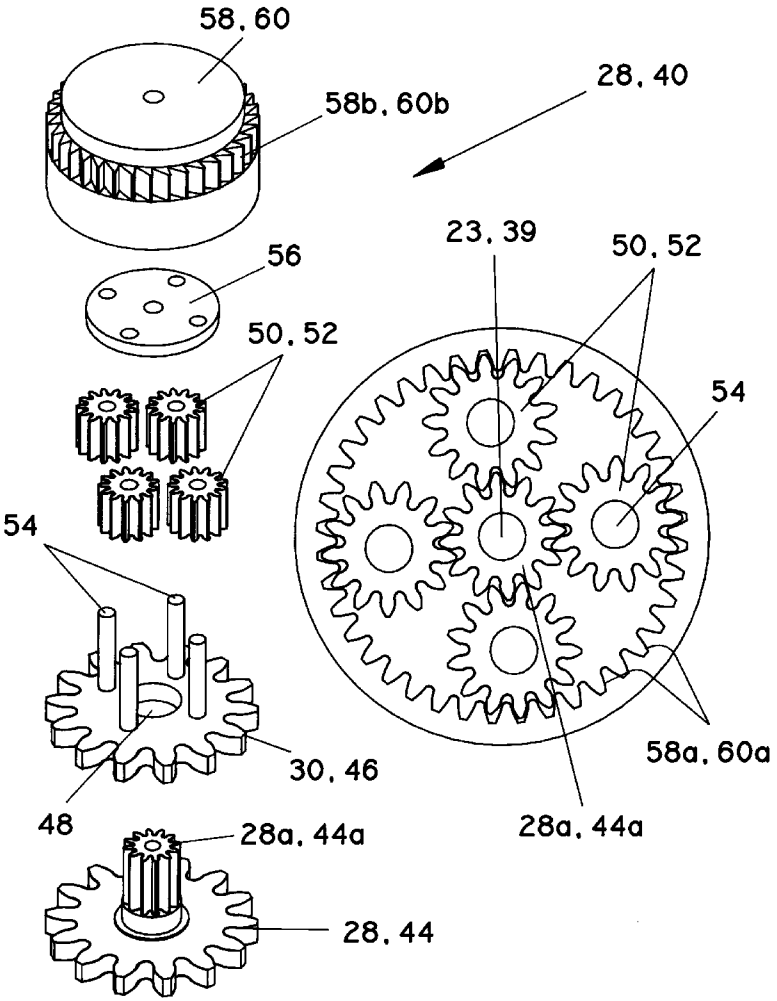
FIG. 5A is an enlarged exploded perspective view of the planetary gear sets of the appliance timer of FIG. 1.
FIG. 5B is a bottom elevational view of the planetary gear sets of FIG. 1.
FIG. 5C is a table showing the magnitude and direction of the respective gears of the planetary gear sets of FIG. 5A.

The high-speed planetary gear set 24 and the low-speed planetary gear set 40 are shown in more detail in FIGS. 5A and 5B. The planetary gear sets 24 and 40 each respectively include a sun gear 28*a* and 44*a* coupled to the input gears 28 and 44, respectively. The sun gears 28*a* and 44*a* are received through an aperture 48 defined in the output gears 30 and 46. Thereafter, the sun gears 28*a* and 44*a* mesh with a number of planetary gears 50 and 52, respectively, which are rotatably disposed on a number of posts 54. The planetary gears 50 and 52 are retained on the posts 54 by a cap 56.

The planetary gears 50 and 52 mesh with a number of gear teeth 58*a* and 60*a* defined in an inner surface of a pair of ring gears 58 and 60, respectively. The ring gears 58 and 60 have a number of ratchet teeth 58*b* and 60*b*, respectively, defined on an outer surface thereof as shown in FIG. 5A. The ratchet teeth 58*b* and 60*b* may be engaged so as to brake or otherwise prevent movement of the ring gears 58 and 60, respectively.

Representative examples of the magnitude and direction of rotation of each of the various gears included in the planetary gear sets 24 and 40 are shown in the table in FIG. 5C. The variables shown in FIG. 5C are as follows: $N_S$=the number of gear teeth defined in the sun gears 28*a*, 44*a*; $N_R$=the number of gear teeth defined in the ring gears 58, 60; and $N_P$=the number of gear teeth defined in each of the planetary gears 50, 52. Preferably, the magnitude of the variables shown in FIG. 5C are as follows:

$$N_S=12;\ N_R=40;\ \text{and}\ N_{P-13}.$$

It should be appreciated that for commonality of parts, the high-speed planetary gear set 24 and the low-speed planetary gear set 40 have identical gear input/output ratios. More specifically, an input rotation speed of equal magnitude on the input gears 28 and 44 will cause an output rotation speed of equal magnitude on the output gears 30 and 46.

However, the gear input/output ratio of the high-speed gear train 22 is greater than the gear input/output ratio of the low-speed gear train 38. Therefore, the output gear 26 of the high-speed gear train 22 will rotate at a faster speed than will the output gear 42 of the low-speed gear train 38. Hence, the input gear 28 of the high-speed planetary gear set 24 will be rotated at a faster speed than the input gear 44 of the low-speed planetary gear set 40 thereby causing the output gear 30 of the high-speed planetary gear set to be rotated at a greater speed than the output gear 46 of the low-speed planetary gear set. Hence, the output gear 30 of the high-speed planetary gear set 24 causes faster rotation of the transfer gear 32, the cam drive gear 34, and the cam 12 than does the output gear 46 of the slow-speed planetary gear set 40.

As shown in FIG. 5C, the output gear 30 will not be energized (i.e. rotated) unless the ring gear 58 is braked, whereas the output gear 46 will not be energized unless the ring gear 60 is braked. Therefore, the transfer gear 32, the cam drive gear 34, and the cam 12 will be rotated at a high speed if the ring gear 58 is braked while ring gear 60 is not braked. It should be noted that if the ring gear 60 is not braked, the low-speed planetary gear set 40 is caused to free spin. What is meant herein by the term "free spin" is that the un-braked ring gear 58 or 60 will rotate at a speed which is dependent upon rotational speed of the transfer gear 32 to which the output gears 30 and 46 are meshingly engaged. Conversely, the transfer gear 32, the cam drive gear 34, and the cam 12 will be rotated at a slow speed if the ring gear 60 is braked while the ring gear 58 is not braked (and therefore caused to free spin).

Rotatably disposed on a post 62 is a pawl 64. The pawl 64 includes a pair of barbs 64*a* and 64*b*. When the pawl 64 is rotated into a first engaged position such that the pawl 64 is moved in a direction toward the ring gear 58, the barb 64*a* is received into one of the ratchet teeth 58*b* thereby preventing the ring gear 58 from rotating relative the post 23. Similarly, when the pawl 64 is rotated into a second engaged position such that the pawl 64 is moved in a direction toward the ring gear 60, the barb 64*b* is received into one of the ratchet teeth 60*b* thereby preventing the ring gear 60 from rotating relative the post 39. Hence, the pawl 64 is used to selectively energize the output gears 30 and 46 of the high-speed planetary gear set 24 and the low-speed planetary gear set 40, respectively.

In order to selectively move an engaging armature 65 included on the pawl 64 toward one of the ring gears 58 and 60, the appliance timer 10 includes a high-speed selector assembly 66 and a low-speed selector assembly 68. The high-speed selector assembly 66 includes a cam follower armature 70 and a directing member 72. On a first end, the cam follower armature 70 includes a stanchion 70*a* which is rotatably received into an aperture 74 defined in a lower housing portion 76. The first end of the cam follower armature 70 also includes a non-rotatable shaft 70*b*. The shaft 70*b* is non-rotatably secured to the directing member 72. The directing member 72 includes a stanchion 72*a* which is rotatably received into an aperture 82 defined in an upper housing portion 84 (see FIG. 2). Hence, the cam follower armature 70 and the directing member 72 rotate relative the lower housing portion 76 and the upper housing portion 84, but do not rotate relative one another.

Similarly, the low-speed selector assembly 68 includes a cam follower armature 86 and a directing member 88. On a first end, the cam follower armature 86 includes a stanchion 86*a* which is rotatably received into an aperture 90 defined in the lower housing portion 76. The first end of the cam follower armature 86 also includes a non-rotatable shaft 86*b*. The shaft 86*b* is non-rotatably secured to the directing member 88. The directing member 88 includes a stanchion 88*a* which is rotatably received into an aperture 94 defined in the upper housing portion 84 (see FIG. 2). Hence, the cam follower armature 86 and the directing member 88 rotate relative the lower housing portion 76 and the upper housing portion 84, but do not rotate relative one another.

Figure 2:
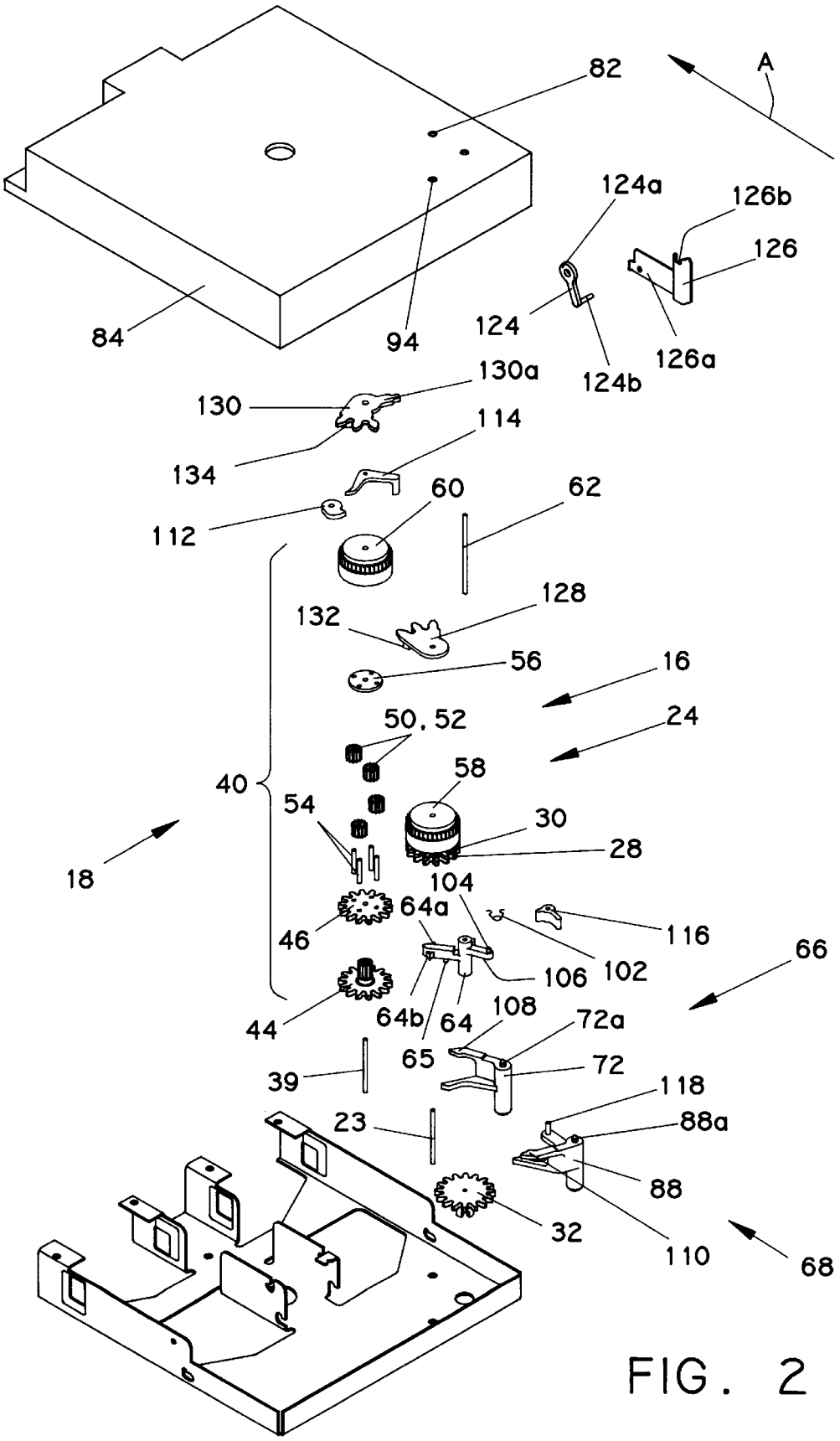
FIG. 2 is an enlarged exploded perspective view of a first portion of the appliance timer of FIG. 1.
Figure 3:
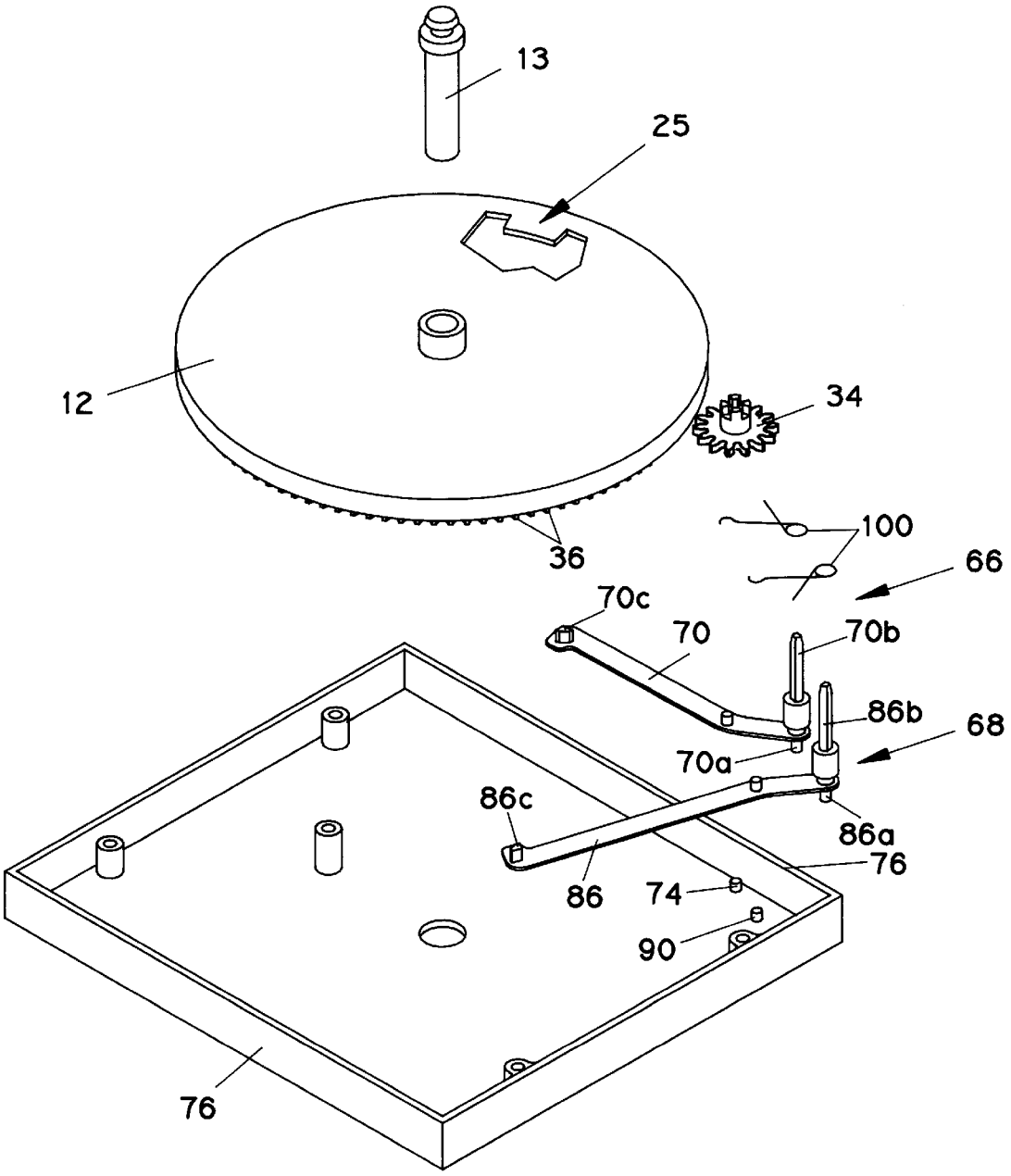
FIG. 3 is an enlarged exploded perspective view of a second portion of the appliance timer of FIG. 1.
Figure 4:
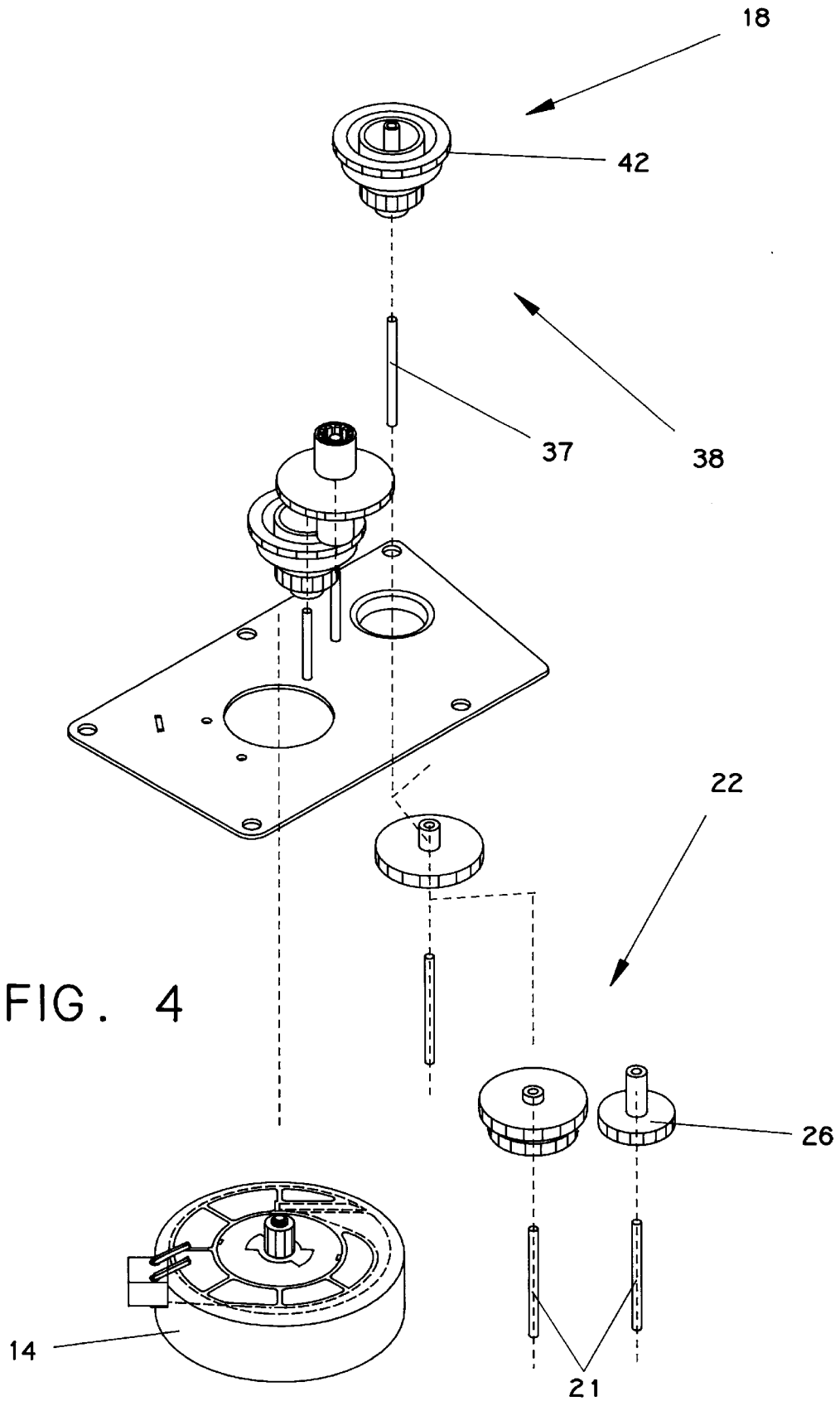
FIG. 4 is an enlarged exploded perspective view of a third portion of the appliance timer of FIG. 1.

An over-center spring 102 is coupled at a first end to the stanchion 72*a* of the directing member 72, and at a second end to a post 104 of an armature 106 included on the pawl 64 (see FIG. 2). The over-center spring 102 generates a bias that retains the pawl 64 in either the first engaged position or the second engaged position wherein the barbs 64*a* and 64*b*, respectively, are engaged with or received into the ratchet teeth 58*b* and 60*b* of the ring gears 58 and 60, respectively. The bias of the over-center spring 102 is overcome when the pawl 64 is rotated past a center point of its path of travel. For example, if the pawl 64 is in its first engaged position and thereafter rotated beyond the center point of its path of travel, the bias of the over-center spring 102 is no longer exerted in a direction so as to retain the pawl 64 in its first engaged position, but rather the bias of the over-center spring 102 is exerted in another direction so as to retain the pawl 64 in its second engaged position.

In order to rotate the pawl 64 in a direction toward the high-speed planetary gear set 24, the directing member 72 includes an armature 108 (see FIG. 2). When the directing member 72 is rotated in a direction toward the pawl 64, the armature 108 contacts the engaging armature 65 of the pawl 64 thereby rotating the pawl 64 in a direction toward the ring gear 58 of the high-speed planetary gear set 24. Once the pawl 64 rotates beyond the center point of its path of travel, the bias of the over-center spring 102 urges the barb 64*a* of the pawl 64 into engagement with the ratchet teeth 58*b* of the ring gear 58 thereby braking the ring gear 58. Once the ring gear 58 is braked, the output gear 30 is caused to rotate at a speed associated with the high-speed gear assembly 16.

Conversely, in order to rotate the pawl 64 in a direction toward the low-speed planetary gear set 40, the directing member 88 includes an armature 110 (see FIG. 2). When the directing member 88 is rotated in a direction toward the pawl 64, the armature 110 contacts the engaging armature 65 of the pawl 64 thereby rotating the pawl 64 in a direction toward the ring gear 60 of the low-speed planetary gear set 40. Once the pawl 64 rotates beyond the center point of its path of travel, the bias of the over-center spring 102 urges the barb 64*b* of the pawl 64 into engagement with the ratchet teeth 60*b* of the ring gear 60 thereby braking the ring gear 60. Once the ring gear 60 is braked, the output gear 46 is caused to rotate at a speed associated with the low-speed gear assembly 18.

Figure 6:
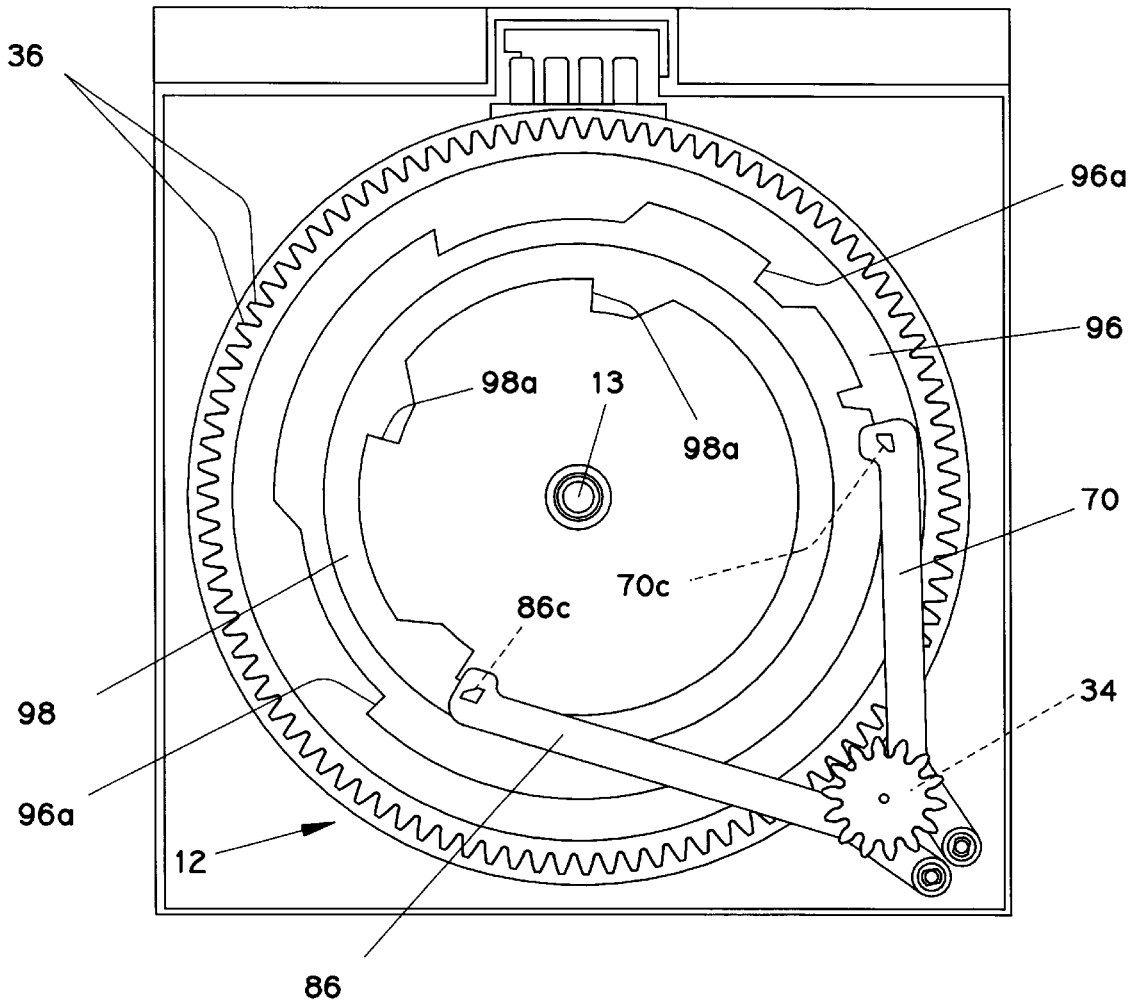
FIG. 6 is a bottom elevational view of the appliance timer of FIG. 1, with the bottom housing portion shown removed for clarity of description.

Referring now to FIG. 6, a second end of each of the cam follower armatures 70 and 86 includes a follower member 70*c* and 86*c*, respectively. The follower member 70*c* follows a radial cam profile 96 defined in the bottom of the cam 12. Similarly, the follower member 86*c* follows a radial cam profile 98 defined in the bottom of the cam 12. The cam profiles 96 and 98 have a number of actuation slots 96*a* and 98*a* defined therein. A return spring 100 (see FIG. 3) is coupled to each of the cam follower armatures 70 and 86 in order to bias the second end of the cam follower armatures 70 and 86 and hence the cam follower members 70*c* and 86*c*, respectively, inwardly toward the shaft 13. Therefore, the cam follower members 70*c* and 86*c* are biased into the actuation slots 96*a* and 98*a* during rotation of the cam 12.

When the follower member 70*c* drops into one of the actuation slots 96*a*, the directing member 72 is rotated in a direction toward the pawl 64 thereby energizing the output gear 30 of the high-speed planetary gear set 24, as described above. Hence, the location and size of the actuation slots 96*a* along the cam profile 96 (see FIG. 6) defines a first period of time at which the cam 12 is being rotated at a high speed by the cam drive gear 34.

Similarly, when the follower member 86*c* drops into one of the actuation slot 98*a*, the directing member 88 is rotated in a direction toward the pawl 64 thereby energizing the output gear 46 of the low-speed planetary gear set 40, as described above. Hence, the location and size of the actuation slots 98*a* along the cam profile 98 (see FIG. 6) defines a second period of time at which the cam 12 is being rotated at a low speed by the cam drive gear 34.

Non-rotatably coupled to the output gear 42 of the low-speed gear train 38 is a pulsing cam 112. As with the output gear 42, the pulsing cam 112 will continue to rotate irrespective of which planetary gear set 24, 40 is engaged by the pawl 64. Rotatably disposed on the post 39 is a pulsing pawl 114. A first end of the pulsing pawl 114 is excited by the pulsing cam 112. A second end of the pulsing pawl 114 contacts a first end of a pulsing lever 116 which is rotatably disposed on a shaft 118 of the director member 88. A second end of the pulsing lever 116 selectively contacts the pawl 64 thereby allowing the barb 64*b* of the pawl to be temporarily urged out of contact with the ratchet teeth 60*b* of the ring gear 60 of the low-speed planetary gear set 40. More specifically, the position of the director member 88 and hence the shaft 118 may be selectively changed by the cam follower member 86 due to the configuration of the actuation slots 98*a* defined in the cam profile 98 such that the second end of the pulsing lever 116 is placed in contact with the pawl 64 in order to move the pawl 64 out of contact with the ratchet teeth 60*b*.

The pulsing lever 116 is configured so as to urge and retain the pawl 64 into a disengaged positioned. More specifically, the pulsing lever 116 urges and retains the pawl 64 away from the ratchet teeth 60*b* during an upward stroke of the pulsing pawl 114. Hence, during the upward stroke of the pulsing pawl 114, the pawl 64 is not engaged with either of the planetary sets 24, 40. The pawl 64 is not urged all the way back to the center point of its path of travel thereby allowing the over-center spring 102 to continue to bias the pawl 64 in a direction toward the ratchet teeth 60*b*. It should be appreciated that when the pawl 64 is not engaged with either of the planetary gear sets 24 and 40, there is no rotation of the transfer gear 32 thereby causing no rotation on the cam 12. However, during a downward stroke of the pulsing pawl 114, the pulsing lever 116 is disengaged from the pawl 64 thereby allowing the bias from the over-center spring 102 to return the barb 64*b* of the pawl 64 into contact with the ratchet teeth 60*b* thereby creating output rotation on the output gear 46 of the low-speed planetary gear set 40, which in turn rotates the cam 12.

Hence, it should therefore be appreciated that the cam profiles 96 and 98 function so as to change the speed at which the cam 12 is rotating. In other words, cam data defined in the cam surfaces on the bottom of the cam 12 causes changes in rotational speed of the cam 12 itself. The cam may be rotated at a high speed, a slow speed, or an interrupted slow speed (i.e. not continuously rotating). The use of multiple speeds allows the cam 12 to be quickly rotated during numerous short time intervals thereby improving the accuracy at which the appliance timer 10 controls a number of critical appliance work operations, while also slowing the cam 12 during time intervals that the appliance timer 10 controls a number of non-critical appliance work operations thereby conserving cam space.

In order to allow the appliance timer 10 to be manually reset or otherwise repositioned by the operator of the appliance, the appliance timer 10 includes a disengagement shaft 120, a spring 122, a lever 124, a sliding member 126, and a pair of sector gears 128 and 130 as shown in FIGS. 1 and 2. A central section of the disengagement shaft 120 is coupled to a first end of the shaft 13 via the spring 122, whereas a knob (not shown) is coupled to a second end of the shaft 13. If an operator of the appliance pushes and rotates the knob, the shaft 13 will likewise be rotated thereby causing rotation of the disengagement shaft 120, which in turn prevents the rocker arms 15 from contacting the cam profiles on the top of the cam 12. Moreover, a first end of the disengagement shaft 120 is received into an aperture 124*a* defined in the lever 124 (see FIG. 2). A post 124*b* included on the lever 124 is received into an aperture 126*a* defined in a first end of the sliding member 126 (see FIG. 2). Rotation of the disengagement shaft 120, such as when the operator pushes and rotates the knob, urges the lever 124 and hence the sliding member 126 in the general direction of arrow A in FIG. 2.

The sector gear 128 is rotatably disposed on the post 23, whereas the sector gear 130 is rotatably disposed on the post 39. The sector gear 128 meshingly engages the sector gear 130. In addition, a tab 130*a* of the sector gear 130 is received into a slot 126*b* defined in the second end of the sliding member 126 (see FIG. 2) thereby causing the sector gears 128 and 130 to rotate when the operator pushes and rotates the knob. The sector gear 128 includes a beveled surface member 132 which, upon rotation of the sector gear 128, cooperates with the directing member 72 so as to lift the high-speed selector assembly 66 thereby preventing the cam follower armature 70 from contacting the cam profile 96. Similarly, the sector gear 130 includes a beveled surface member 134 which, upon rotation of the sector gear 130, cooperates with the directing member 88 so as to lift the low-speed selector assembly 68 thereby preventing the cam follower armature 86 from contacting the cam profile 98.

Conversely, when the operator pulls the knob, the disengagement shaft 120 rotates back to its original position thereby positioning the rocker arms 15 back into contact the cam profiles on the top of the cam 12. In addition, the cam follower armatures 70 and 86 are positioned back into contact with the cam profiles 96 and 98, respectively.

As described above, the appliance timer 10 includes a rotating cam 12 which can selectively change speeds so as to rotate at a high speed when actuating and deactuating switches within the appliance timer so that improved timing accuracy of particular (i.e. critical) work operations is achieved, and yet rotate the cam at a low speed when the appliance timer is actuating or deactuating switches associated with other (i.e. non-critical) work operations so that space on the surface of the cam is conserved. Such an appliance timer design creates numerous advantages over other appliance timers which have heretofore been developed.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

For example, although the cam 12 is described as a single, horizontally disposed cam, other cam configurations could also be used. For example, the cam 12 could be multiple cylindrical cams (e.g. a camstack) with separate cam profiles functioning as the cam profiles 25, 96, and 98.

What is claimed is:

1. An appliance timer, comprising:

a group of output terminals; and a cam having defined therein (1) a first set of cam profiles which controls when output signals are to be generated on said group of output terminals, and (2) a second set of cam profiles which controls speed of said cam.

2. The appliance timer of claim 1, further comprising:

a motor;

a first gear assembly which mechanically couples said motor to said cam during a first period of time, and a second gear assembly which mechanically couples said motor to said cam during a second period of time.

3. The appliance timer of claim 2, wherein:

said cam is rotated at a first speed during said first period of time, and said cam is rotated at a second speed during said second period of time.

4. The appliance timer of claim 3, wherein:

said motor is decoupled from said cam during a third period of time.

5. The appliance timer of claim 2, further comprising:

a first speed selector assembly which is mechanically interposed between said first gear assembly and said cam; and a second speed selector assembly which is mechanically interposed between said second gear assembly and said cam.

6. The appliance timer of claim 5, wherein:

said first gear assembly includes a first gear train having a first gear input/output ratio, said second gear assembly includes a second gear train having a second gear input/output ratio, and said first gear input/output ratio is greater than said second gear input/output ratio.

7. The appliance timer of claim 6, wherein:

said first gear assembly includes a first planetary gear set which is mechanically coupled to said first gear train, and said second gear assembly includes a second planetary gear set which is mechanically coupled to said second gear train.

8. The appliance timer of claim 7, further comprising:

a pawl which is positionable at (1) a first engaged position in which said pawl engages said first planetary gear set during said first period of time, and (2) a second engaged position in which said pawl engages said second planetary gear set during said second period of time.

9. The appliance timer of claim 8, wherein said pawl is further positionable at a disengaged position in which said pawl does not engage said first planetary gear set or said second planetary gear set during said third period of time.

10. The appliance timer of claim 8, further comprising;

a lever which selectively positions said pawl between said second engaged position and said disengaged position.

11. An appliance timer, comprising:

a motor;

a first gear assembly which is mechanically coupled to said motor;

a second gear assembly which is mechanically coupled to said motor; and a cam which is driven by (1) said first gear assembly during a first period of time, and (2) said second gear assembly during a second period of time, said cam having a set of cam profiles which control the selection of the gear assembly to drive said cam.

12. The appliance timer of claim 11, wherein:

said cam is rotated at a first speed during said first period of time, and said cam is rotated at a second speed during said second period of time.

13. The appliance timer of claim 12, wherein:

said motor is decoupled from said cam during a third period of time.

14. The appliance timer of claim 11, further comprising:

a first speed selector assembly which is mechanically interposed between said first gear assembly and said cam; and a second speed selector assembly which is mechanically interposed between said second gear assembly and said cam.

15. The appliance timer of claim 14, wherein:

said first gear assembly includes a first gear train having a first gear input/output ratio, said second gear assembly includes a second gear train having a second gear input/output ratio, and said first gear input/output ratio is greater than said second gear input/output ratio.

16. The appliance timer of claim 15, wherein:

said first gear assembly includes a first planetary gear set which is mechanically coupled to said first gear train, and said second gear assembly includes a second planetary gear set which is mechanically coupled to said second gear train.

17. The appliance timer of claim 16, further comprising:

a pawl which is positionable at (1) a first engaged position in which said pawl engages said first planetary gear set during said first period of time, and (2) a second engaged position in which said pawl engages said second planetary gear set during said second period of time.

18. The appliance timer of claim 17, wherein said pawl is further positionable at a disengaged position in which said pawl does not engage said first planetary gear set or said second planetary gear set during said third period of time.

19. A method of operating an appliance timer, comprising the steps of:

providing a cam having defined therein (1) a first set of cam profiles, and (2) a second set of cam profiles;

controlling generation of output signals on a group of output terminals of the appliance timer with the first set of cam profiles; and controlling speed of the cam with the second set of cam profiles.

* * * * *